United States Patent [19]

Bernauer et al.

[11] Patent Number: 4,552,068

[45] Date of Patent: Nov. 12, 1985

[54] GRAVURE CYLINDER

[75] Inventors: Joachim Bernauer; Joachim Dorow, both of Frankenthal; Primin Göbel, Lambsheim, all of Fed. Rep. of Germany

[73] Assignee: Albert-Frankenthal AG, Frankenthal, Fed. Rep. of Germany

[21] Appl. No.: 565,344

[22] Filed: Dec. 27, 1983

[30] Foreign Application Priority Data

Jan. 11, 1983 [DE] Fed. Rep. of Germany ..... 3300678

[51] Int. Cl.[4] ..... B41F 27/12

[52] U.S. Cl. ..... 101/415.1

[58] Field of Search ..... 101/415.1, 378

[56] References Cited

U.S. PATENT DOCUMENTS

| | | | |
|---|---|---|---|
| 1,730,122 | 10/1929 | Busk | 101/415.1 |
| 1,773,949 | 8/1930 | Casto | 101/415.1 |
| 1,858,305 | 5/1932 | Meisel et al. | 101/415.1 |
| 2,051,858 | 8/1936 | Huck et al. | 101/415.1 |
| 2,194,424 | 3/1940 | Grupe | 101/415.1 |
| 2,629,324 | 2/1953 | Smith | 101/415.1 |
| 3,540,376 | 11/1970 | Corse | 101/415.1 |
| 3,946,670 | 3/1976 | Cerny et al. | 101/415.1 X |
| 4,157,067 | 6/1979 | Datwyler | 101/415.1 |

FOREIGN PATENT DOCUMENTS

| | | | |
|---|---|---|---|
| 367436 | 2/1932 | United Kingdom | 101/415.1 |
| 2092956 | 8/1982 | United Kingdom | 101/415.1 |

*Primary Examiner*—Edgar S. Burr
*Assistant Examiner*—Charles A. Pearson
*Attorney, Agent, or Firm*—Collard, Roe & Galgano

[57] ABSTRACT

A gravure printing machine cylinder has a means for mounting wrap-on gravure plates thereon using a tensioner able to be rocked about the shaft of the cylinder and having an outer cylindrical face in keeping with the outline of the cylinder in the printing condition. In order to be certain of a truly cylindrical outline of the wrap-on plate that is to be fixed on the cylinder, while at the same time decreasing the distance through which the plate is pulled when being mounted, the tensioner has a member with a beaked rim that is able to be rocked about an axis parallel to the cylinder axis separately from the tensioner, said beaked rim functioning with a gripping part in taking up and fixing in place the mounting fold or flap of the wrap-on plate.

9 Claims, 4 Drawing Figures

GRAVURE CYLINDER

BACKGROUND OF THE INVENTION

The present invention is with respect to gravure printing machine cylinders having means for mounting and tensioning wrap-on plates, using a tensioner that is able to be rocked about the shaft of the cylinder and has an outer surface in keeping with the plate supporting radius or outline of the cylinder.

In the case of known plate mounting or fixing means of this sort the tensioner has to be rocked through a relatively large angle about the shaft of the cylinder in order to get the axis-parallel ends of the plate, that are in the form of bent-back folds or have slats fixed thereto, fitted on the edge, that is in the front in the direction of tensioning, of the tensioner. This has an undesired effect on the load supporting power or strength of the back end of the tensioner in the joint. This shortcoming is more specially serious when the end of the plates have mounting folds that are very long and are bent back at an acute angle.

Gravure printing machine cylinders have furthermore been designed with a plate mounting system whose tensioner is only able to be rocked about an axis which is eccentric in relation to the shaft of the cylinder so that the edge which is leading (with respect to the direction of tightening the plate) may be moved inwards and outwards in the radial direction. Although on the one hand this makes it simpler for the fold of the plate to be mounted, on the other hand this sort of mounting means makes it necessary for the plates to be made highly true to size, that is to say, to keep to tight production tolerances. The reason for this is that in the case of these known systems there is only one given working position of the tensioner, in which the outer face or form of the tensioner is centered on the axis of the cylinder, that is to say so that the outer faces of the tensioner and of the rest of the cylinder are co-cylindrical. In other words, as long as the tensioner is not in this position, it will be at an angle in relation to the rest of the outer face of the cylinder with part thereof at a greater radius from the cylinder axis and part thereof at a smaller radius from the axis than the said rest of the outer face of the cylinder. In fact, if the wrap-on plate to be mounted is overlong or overshort because of manufacturing tolerances, the tensioner will then not be able to be rocked into its true co-cylinderical position and will keep in a position with the two circumferential ends thereof forming steps or ledges with the ends of the rest of the outer part of the cylinder. Such steps wil be the cause of the impression cylinder and the doctor sharply kicking against the plate cylinder where the steps are and vibration being caused so that ink is likely to be splashed onto the paper or stripes formed thereon. And there is furthermore a chance of the paper tearing because of the force acting thereon.

SHORT OUTLINE OF THE INVENTION

Taking into account these shortcomings one purpose of the present invention is that of designing a gravure printing press cylinder of the sort noted, in the case of which one may be certain that the tensioner will in all cases take up a truly centered position in relation to the axis of the cylinder even when the plate is greatly over- or undersized, that is to say when tight manufacturing tolerances are not kept to in this respect, and the outer face of the plate will be truly cylindrical.

A still further purpose of the invention is that of designing a cylinder in the case of which the plate-tensioning operation is such that the tensioner only has to be moved through a very small angle about the cylinder shaft even when mounting plates with very long mounting folds bent back at an acute angle.

For effecting these and further purposes the tensioner, that is able to be rocked about the cylinder shaft, has a beaked rim that may be rocked about an axis that is parallel to the cylinder shaft for functioning with a gripping part in taking up the one mounting fold of the wrap-on plate.

In this case there is the useful effect that the beaked rim of the tensioner is able to be rocked about the axis that is spaced from and parallel to the cylinder shaft out of position in which it is coaxial with the rest of the outer face of the cylinder and may then be rocked back again (about the cylinder shaft) for pulling tight the wrap-on plate. This rocking function of the beaked rim in an outward direction so that it is no longer co-cylinderical with the rest of the outer face of the cylinder makes it simpler for the inwardly acutely angled mounting folds of the plate to be pushed into position so that furthermore the production of the plate will be simpler. At the same time the operation of mounting the plate is less trouble for the user to undertake. This is furthermore true for very long mounting folds that are bent at a very acute angle so that there is no need for the folds to be opened out and the gripping parts used therewith will be simpler in their design. Using the gripping part it becomes possible for the plate to be truly positioned even before it is pulled tight so that there is no danger of the plate's ends slipping out of place. This makes the part of the mounting operation in which the folds are threaded into the cylinder very much simpler and there is a beneficial effect with respect to makeready of the printing press. Seeing that the beaked rim may be moved outwards for placing the one fold into position, one may at the same time be certain that the operation of pulling the plate tight in the form of a rocking motion about the cylinder axis is only through a relatively small angle so that the joint gap or well between the beaked rim and the edge of the tensioner opposite thereto is very small in size and there are no undesired effects on the plate supporting function.

In keeping with a first form of the invention the tensioner may be in the form of a single-piece segment and rockingly supported in a chair that is able to be rocked about the shaft of the cylinder, said segment being able to be locked in relation to the chair. Such a design may be very simple.

In keeping with a more specially preferred form of the invention the tensioner has a segment that is able to be rocked about the cylinder shaft and on the segment there is an edge rail with an outer part-cylindrical face centered on the cylinder shaft, such edge rail being able to be rocked about an axis parallel to the cylinder shaft. In this case it is possible for the beaked edge on the edge rail side to be moved a long way out of position for mounting the fold so that the mounting operation becomes much simpler even if the mounting fold has a sharp angle, and this without having to have a special space at the segment where it is nearest to the beaked edge.

In keeping with a useful development of the invention this segment may have a pocket-like space running inwards from the outer face of the segment part-cylindrically so as to be centered on the axis of the edge rail, a part-cylindrical part of the edge rail fitting into this space with the outcome that there is hardly any clearance between the edge rail and the segment.

As part of a still further useful development of the invention there is a stop for keeping the edge rail in its working position in relation to the segment. This stop automatically keeps the edge rail in its desired working position in which it is co-cylindrical with the rest of the outer face of the cylinder so that the utility of the system is generally increased.

In keeping with a further outgrowth of the invention the segment next to the tensioner may be of such a size that it takes up about half of the circumference of the cylinder. This makes certain that any points at which the paper is nipped at the joints between the segment on the tensioner side and the part of the cylinder that is stationary in relation thereto are produced in the cut or the fold in the paper that is printed and then cut down to size.

As part of a further useful development of the invention the segment on the tensioner side is supported by an eccentric shaft at the point diametrically opposite to the beaked rims on whichever cylinder section is next thereto. These further measures of the invention give a simply designed and simply worked tensioning system. However it would furthermore be possible to have a tightening means in the form of a sealed length of flexible hose to be charged with fluid under pressure for driving the tensioner in place of the said eccentric shaft.

It is furthermore possible for the segment to be crenellated at its part on the side of the joint next to the cylinder section diametrically opposite to the beaked rims and for such crenellations to be interlocked with crenellations on a further part of the cylinder so that the joint does not have a straight gap but rather a gap in the form of short lengths running on two parallel lines joined by cross gaps. This gives a greater supporting effect so that there is generally no danger of an impression of the gap being produced on the paper. It is furthermore useful if the joint is placed at a slope in relation to a line running parallel to the axis on the outer face of the cylinder, that is to say helically, this being a further way of increasing the strength and load supporting effect of the cylinder.

As a further useful effect to be produced with the present invention the two beaked rims may have gripping rails placed next to them, such gripping rails being opposite to each other and having in their opposite faces at least one groove or channel running the full length of the rails, such grooves taking up a sealing strip running the full length of the rails. The gripping rails make it possible for the plate ends to be truly fixed in place before the tightening operation as such is undertaken so that there is no danger of the plate ends slipping out of place and the mounting operation is for this reason made much simpler and readily undertaken by the pressman. The sealing strip kept in place by gripping rails at the same time is not only responsible for a simple way of sealing the well between the plate ends but furthermore makes for an increase in the gripping force of the gripping rails when the gripping motion is started. A useful effect is produced if the said sealing strip is in the form of a piece of flexible hose that is simply placed in the channel made therefor; then by joining it up with fluid under pressure it may be forced against the wall faces of the channel.

For stopping the printing ink making its way into the well to the radially outer side of the sealing strip, the well may be filled up by the injection of a curing material. For this purpose a useful effect is produced if the gripping rails have an injection or feed duct that may be joined up with an injection machine so that there is an even distribution of the filling material The ends of the wrap-on plate in the forms of mounting folds may be stepped so that the side limits of the well, that is to be filled with material, are neatly shut off and for this reason there are regular surfaces against which the filling material comes to rest. Such material is in this case walled in circumferentially by the steps on the plate and even although the beaked edges are rounded will not take on the form of an infinitely narrowing wedge, this as well being a useful effect in connection with producing a truly cylindrical outline.

Further details of the invention in preferred forms thereof will be seen from the account now to be given of working examples thereof as presented in the figures.

LIST OF DIFFERENT VIEWS OF THE FIGURES

DETAILED ACCOUNT OF THE WORKING EXAMPLES OF THE INVENTION

Figure 1:
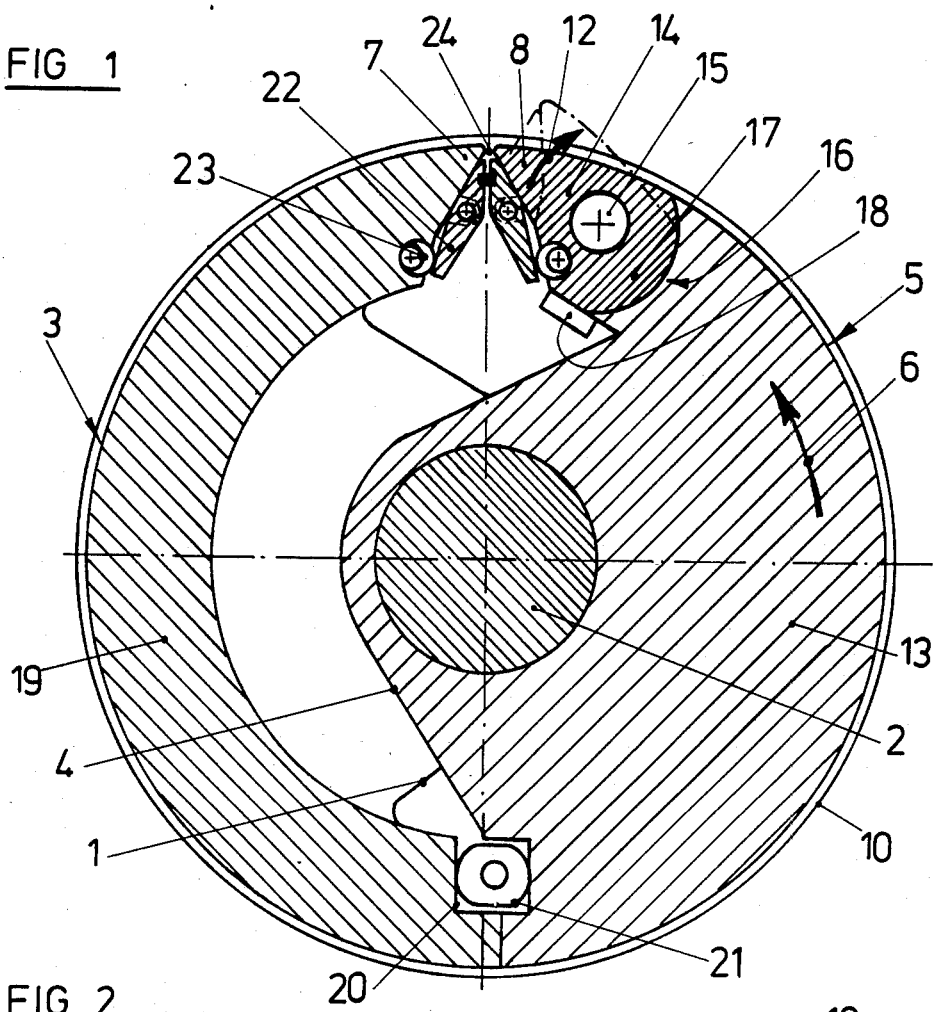
FIG. 1 is a cross section taken through a gravure cylinder having a two-piece tensioner.
Figure 2:
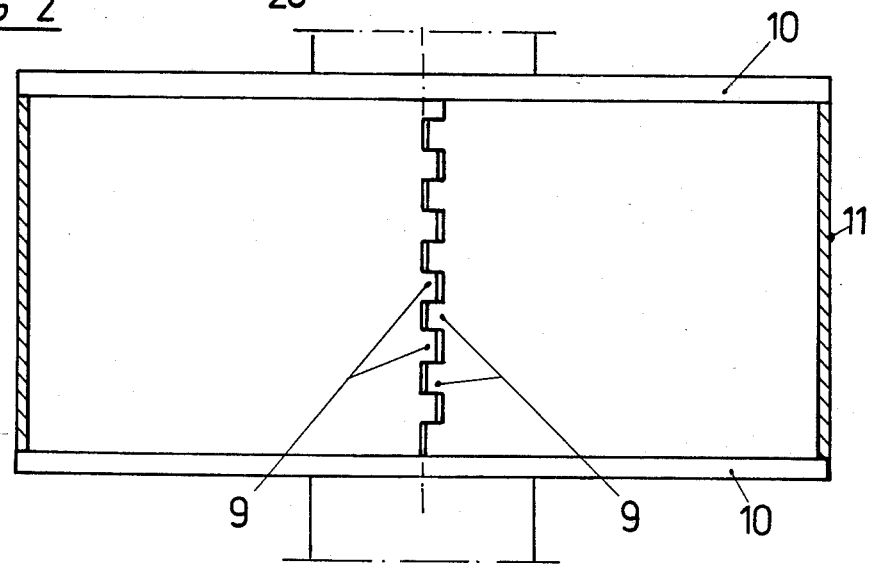
FIG. 2 is a view looking up towards the cylinder as in FIG. 1, that is to say looking towards the side diametrically opposite to the beaked edges.
Figure 3:
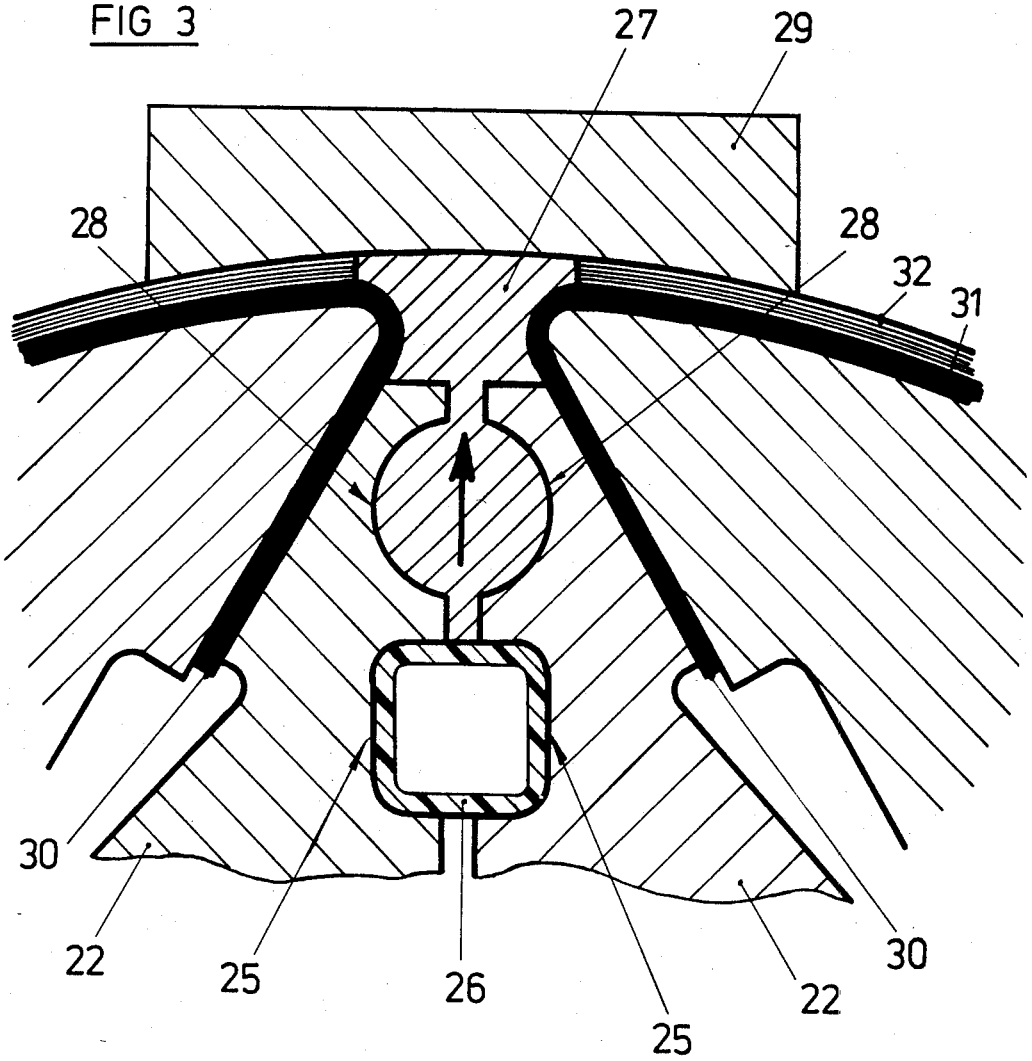
FIG. 3 is a view of part of the structure to be seen in FIG. 2 with the plate gripping part on a larger scale.

The intaglio or gravure cylinder to be seen in FIG. 1 is designed for use with a wrap-on plate, not to be seen in detail, and is made up on the one hand of a shell segment part 3 that is rigidly joined to the middle shaft 2 by way of in-running webs 1, and on the other hand of a tensioner 5, whose outer face is in line with the outline of the cylinder, that is to said co-cylindrical therewith, and which is rockingly joined with the shaft 2 by way of webs 4 having eyes in which the shaft 2 is placed. The tensioner 5 may be moved around the axis of the shaft 2 in relation to the segment part 3 for tensioning and pulling tight the wrap-on plate in the circumferential direction as marked by the arrow 6. The segment part 3, that is rigidly joined to the shaft 2, and the tensioner 5 each take up half of the circumference of the cylinder in the present working example and at one of the two ends thereof there are beaked rims 7 and 8 for locking inwardly bent mounting folds of the wrap-on plate, not figured. The form of the folds will best be seen from FIG. 3. At their other edges the segment part 3 and the tensioner 5 have interlocking crenellated edges 9. In the present working example the crenellated edges 9 are parallel to an axis-parallel generatrix of the outer face of the cylinder. Inasfar as may be necessary to give the desired strength, the crenellated edges 9 may be placed at a small slope in relation to such a generatrix. At the ends of the cylinder there are bearer rings 10, forming a means for supporting the doctor at the joint between the beaked rims 7 and 8 so that its is safely guided and supported thereover. The bearer rings extend beyond the rest of the outer face of the cylinder by an amount the same as the thickness of the intaglio plate, such thickness being marked in FIG. 2 at 11, so that when the wrap-on plate is in place the joint as its ends may be run over smoothly by the said doctor. Furthermore the bearing rings may be produced by turning the cylinder on a lathe in the form of collars. To make it simpler for the mounting folds on the wrap-on plate to be placed in position, the beaked rim 8 on the tensioner is able to be rocked out of position radially as is marked in broken lines in figure 1 in the direction of the arrow 12. To make this possible the tensioner 5 is in the present working example made in two pieces, that is to say, on the one hand a segment 13 rockingly joined to the cylinder shaft 2 with an edge rail 14, having the beaked rim 8 thereon, said rail 14 being rockingly joined with a shaft 15, that is parallel to but at some distance from the cylinder shaft 2. The shaft 15, that may be in the form of a pin or the like, may have its ends supported at the end bearer rings 10, that then have to be able to be moved together with the tensioner 5 about the cylinder shaft 2. However it would furthermore be possible for the edge rail 14 to be supported by a hinge joint or the like on the segment 13 itself of the tensioner 5 or on eye lugs placed at the end thereof. The edge rail 14 of tensioner 5 has an outer face radius with the same curvature as the outer face of the cylinder so that in the home position (see FIG. 1) of the tensioner it is fully lined up with rest of the outer face of the cylinder and on one circle therewith when the cylinder is looked at in the direction of its axis.

The segment 13 on the tensioner will be seen in the present working example to have at its edge rail a pocket-like space 16 that takes up a part-cylindrical structure 17 on the edge rail 14. The seat 16 and the space 17 are produced with bearer faces that are curved so as to be concentric to the shaft 15, such faces running as far as the outer face of the cylinder to make it possible for the beaked rim 8 to be rocked outwards through a large angle and there is a firm, load-supporting joint between the segment 13 and the edge rail 14. After putting the mount fold in question in position the edge rail 14 is turned inwards out of the position marked in broken lines in FIG. 1 about the shaft 15 so far that its outer curved face is lined up with the circular limiting line as represented by the outline of the cylinder and the said outer face thereof is centered on the axis of the shaft 2. The plate may be pulled tight or tensioned by rocking the tensioner 5 bodily about the shaft 2 of the cylinder. The working position of the edge rail 14 is in the present working example defined by a stop rail 18, that is here fixed to the edge rail 14 and in the working position is rested against a support face therefor on the segment 13. The rocking motion of the edge rail 14 about its shaft 15 may be produced by a toggle lever drive that is not marked in the figure, or more specially by a shaft with an eccentric. Such an eccentric may furthermore be used for producing the rocking motion of the segment 13 and for this reason of the complete tensioner 5 about the shaft 2 of the cylinder and in fact in the present working example the tensioning means for driving the tensioner 5 is in the form of an eccentric shaft 21, that is in a channel 20 in a joint gap formed at the crenellated rails 9 between the segment 13 on the tensioner and a segment 19 forming part of the segment 3 that is keyed on the cylinder shaft 2. The eccentric shaft 21 may be worked from the end thereof, that is to say from the end or side face of the cylinder. The eccentric shaft 21 is so placed as to be bridging over the joint gap and on one side is rested against the segment 13 and on the other side is rested against the segment 19. In place of the eccentric shaft 21 it would furthermore be possible to have a flexible-walled pipe which would be able to be expanded by the supply of liquid under pressure thereto by way of valve at one end of its, such valve not being marked in the figures. On such expansion of the pipe taking place because of the pressure acting therein the tensioner 5 would be moved thereby in the direction of the arrow 6.

To keep the circumferential ends of folds of the plate in position on the beaked rims 7 and 8 without any chance of slipping, there are gripping parts that may be fixed thereon and in the present case are in the form of rocking gripping rails 22 running from one end of the cylinder to the other. The gripping rails 22 are in the present working example of the invention each worked by an eccentric shaft 23. For makeready of a cylinder the wrap-on plate is firstly fixed in position by slipping its fold onto the beaked rim 7 of the stationary segment, then wrapped round the outer face of the cylinder and then gripped firmly in position on the outwardly moved beaked edge 8 of the tensioner 5 using the gripping rail 22 thereof. Because the plate is locked in position at its ends one may be certain that there is no chance of its slipping so that the plate does not additionally have to be kept in place while being pulled tight on the cylinder. The next step is for the edge rail 14 having the beaked rim 8 to be rocked back till the stop rail 18 has run up onto its stop face. Thereafter the tightening in the more limited sense of the word takes place by rocking the tensioner 5 bodily about the shaft 2 of the cylinder, the plate keeping exactly to a round or circular form whatever angle the tensioning parts have to be moved through before the plate has been pulled tight.

The well 24, that is still present after the plate has been pulled tight, between the plate ends is sealed off by injecting a curing composition thereinto. To make such injection possible the gripping rails 22 will be seen more specially from FIG. 3 to have grooves 25 running right along them, said grooves 25 forming two halves of a duct, into which a sealing strip 26 may be placed. The sealing strip 26 may be placed loosely in position before the plate is tensioned. Because of the tightening operation the duct for the sealing strip is made narrower so that the sealing strip 26 is forced against the bore of the duct, that is to say the inner face of the wall thereof. The sealing strip 26 may take the form of a sealing plug of elastic material or of a tear-out wire that may be pulled out for breaking up the resin mass before a new plate is fixed in position. In the present working example of the invention the sealing strip 26 is to be in the form of a flexible pipe with complete walls without any openings and which may be loaded with fluid under pressure by way of a valve that is placed near one of the bearer rings. Such a pressure driving or expansion effect and such an increase in pressure as produced at the time of the tensioning operation is amplified by the gripping force caused by the gripping rails 22.

To get an even distribution of the filling 27 to be injected by way of the well 24, the gripping rails 22 have further grooves 28 together forming a further channel or feeder duct along the length of the gripping rails and which may take up the filling material. The injection of the filling material may be done in such a way that there is a more or less deep ink well thereover in which ink collected will be kept radially clear of and within the radius of the plate's outer face. In the present working example, however, the well 24 is completely filled up with resin so that there is no trouble with ink collecting therein and fouling the paper. To this end, when the resin is injected, the outer limit of the filling material is formed by a molding beam 29 with a concave surface generated by the radius of the outer plate surface. For this reason the well 24 is limited by the molding beam 29 to the outside, the sealing strip 26, the end bearer rings 10 and the beaked rims 7 and 8 so that the filling material 27 may be injected under high pressure. As a simple way of limiting or sealing off the filling material 27 at the outer limit of the wrap-on plate, the same is stepped back in thickness near the folds 30 at its edges that are parallel to the axis of the cylinder. In fact the wrap-on plate is best made of a load bearing or support base material 31 and a coating thereon having the intaglio printing image therein, such coating 32 coming to an end short of the folds.

Figure 4:
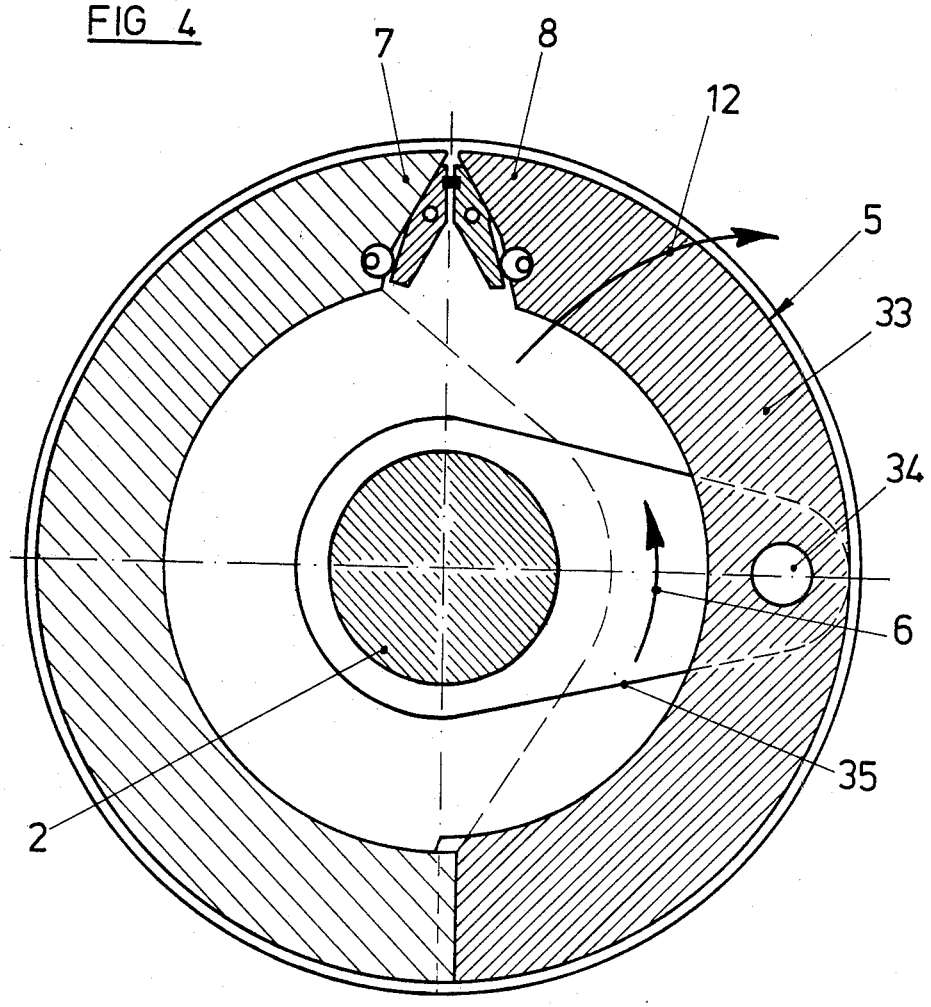
FIG. 4 is a cross section through a further working example of the present invention with a single-piece tensioner.

In place of a two-piece tensioner having a rocking edge rail, it would be possible, see FIG. 4, to have a single-piece tensioner. By and large the mechanical design is like that of the system of FIG. 1 so that for like parts like part numbers are used. The one-piece tensioner 5 is in this case formed by a segment 33 forming about one half of the cylinder and on which the beaked edge 8 thereof is formed. The single-piece tensioner 5 may be rocked about the pin 34 that is parallel to the cylinder of the axis 2, the pin 34 for its part being supported on a support arm 35 rockingly supported on the cylinder shaft 2. In this respect the segment 33 is able to be locked in its working position in relation to the support arm 35. The threading the fixing fold in position the complete segment 33 is rocked bodily in the direction of the arrow 12 about the eccentric pin 34 so that the beaked edge 8 is moved further from the axis of the cylinder and "out of normal outline of the cylinder". For mounting the plate the segment 33 is rocked bodily as marked by the arrow 6 about the axis of the cylinder shaft 2. The further details of the design of the cylinder of FIG. 4 may be as in FIG. 1 so that in order not to be repetitive reference may be had thereto.

We claim:

1. A gravure cylinder for a gravure printing press, said gravure cylinder having an axial shaft and being capable of accepting an intaglio wrap-on plate having an imprecise length with inwardly turned folds at the circumferential edges thereof, said gravure cylinder comprising:

(a) a first casing means in the form of a segment of said cylinder fixed in relation to the axial shaft of said cylinder and having a beaked rim structure, (b) a second casing means which together with said first casing means forms a body with an outer cylindrical face corresponding to said cylinder, said second casing means being a plate tensioner forming generally one half of said cylinder supported on said axial shaft for pivoting movement thereabout in relation to said first casing means, (c) an edge rail with a beaked rim structure pivotally mounted to said plate tensioner about an axis spaced radially from and parallel to said axial shaft, said edge rail having an outer surface being co-cylindrical with said cylinder, said beaked rim structure opposing the beaked rim structure of said first casing means, (d) means mounted on said cylinder for pivotally moving said plate tensioner to reposition the beaked rim structure thereof circumferentially with respect to the beaked rim structure of said first casing means to thereby accommodate wrap-on plates on said cylinder of imprecise lengths, (e) a gripping rail associated with each beaked rim structure for gripping each associated fold of said intaglio plate, each said gripping rail being pivotably mounted so as to grip the associated fold of said plate between said beaked rim structure and said gripping rail, each gripping rail including a groove along the length thereof, said grooves being in complementary aligned relationship to one another, and (f) a resilient sealing strip disposed within the complementary grooves of said gripping rails, said sealing strip and said gripping rails defining a cavity therebetween in which a filling material is inserted to seal the surface of said cylinder.

2. The gravure cylinder as claimed in claim 1 wherein said tensioner is in the form of a single-piece segment, and said cylinder further comprising a support arm able to be rocked about the cylinder axis and rockingly supporting said tensioner.

3. The gravure cylinder as claimed in claim 1 wherein the means for pivotally moving said plate tensioner comprises a driving means generally diametrically opposite to said beaked rim structure for moving an axis-parallel limit of said tensioner towards an axis-parallel edge of a further part of the cylinder, edges of said tensioner and of said second casing means next thereto at said driving means being crenellated and interlocking with each other.

4. The gravure cylinder as claimed in claim 3 wherein a well is formed between the ends of said wrap-on plate, said well being filled with said filling material, a feeder duct formed between said gripping rails communicating with said well and through which said filling material is injected to said well, and filling material being molded against a beam placed over said well with a radiused face thereof turned into said well and co-cylindrical with the outer face of said tensioner.

5. The gravure cylinder as claimed in claim 13 wherein said gripping rails are designed running from one end of said cylinder to the other and said sealing strip is hollow so that fluid under pressure therein may cause a sealing effect.

6. The gravure cylinder as claimed in claim 1 wherein said wrap-on plate has stepped ends parallel to the said axis for forming a seal to keep said filling material in a well between the ends of the plate.

7. The gravure cylinder as claimed in claim 1, which further includes bearer rings running continuously around the ends of the cylinder.

8. The gravure cylinder as claimed in claim 1, wherein the means for pivotally moving said plate tensioner includes an eccentric shaft generally diametrically opposite said beaked rim structure for moving an axis-parallel limit of said plate tensioner towards an axis-parallel edge of said first casing means with the folds of said wrap-on plate between them.

9. The gravure cylinder as claimed in claim 1, wherein said pivotally mounted beaked rim structure of said edge rail is arranged such that a part-cylinder part of said edge rail is taken up in a pocket in said plate tensioner with small clearance therebetween, and a stop for keeping said edge rail in a working position thereof.

* * * * *